United States Patent [19]

Ochs

[11] Patent Number: 4,809,858

[45] Date of Patent: Mar. 7, 1989

[54] COMPOSITE CLOSURE CAP WITH REMOVAL TORQUE CONTROL

[75] Inventor: Charles S. Ochs, Lancaster, Ohio

[73] Assignee: Anchor Hocking Corporation, Lancaster, Ohio

[21] Appl. No.: 109,750

[22] Filed: Oct. 19, 1987

[51] Int. Cl.[4] ..... B65D 41/04

[52] U.S. Cl. ..... 215/276

[58] Field of Search ..... 215/276, 329

[56] References Cited

U.S. PATENT DOCUMENTS 520,014 5/1894 Smith ..... 215/276

1,134,069 3/1915 White ..... 215/276

2,270,729 1/1942 Geddes ..... 215/276

3,913,772 10/1975 Ochs ..... 215/330 X

*Primary Examiner*—Donald F. Norton

*Attorney, Agent, or Firm*—Stoll, Wilkie, Previto & Hoffman

[57] ABSTRACT

A composite closure cap is described comprising a molded plastic ring and a separate disc-like cover. The cover includes a gasket for sealing. Tapered friction surfaces on the plastic ring and on the cover interact to provide for the control of the closure cap removal torque.

5 Claims, 3 Drawing Sheets

Fig. 7.
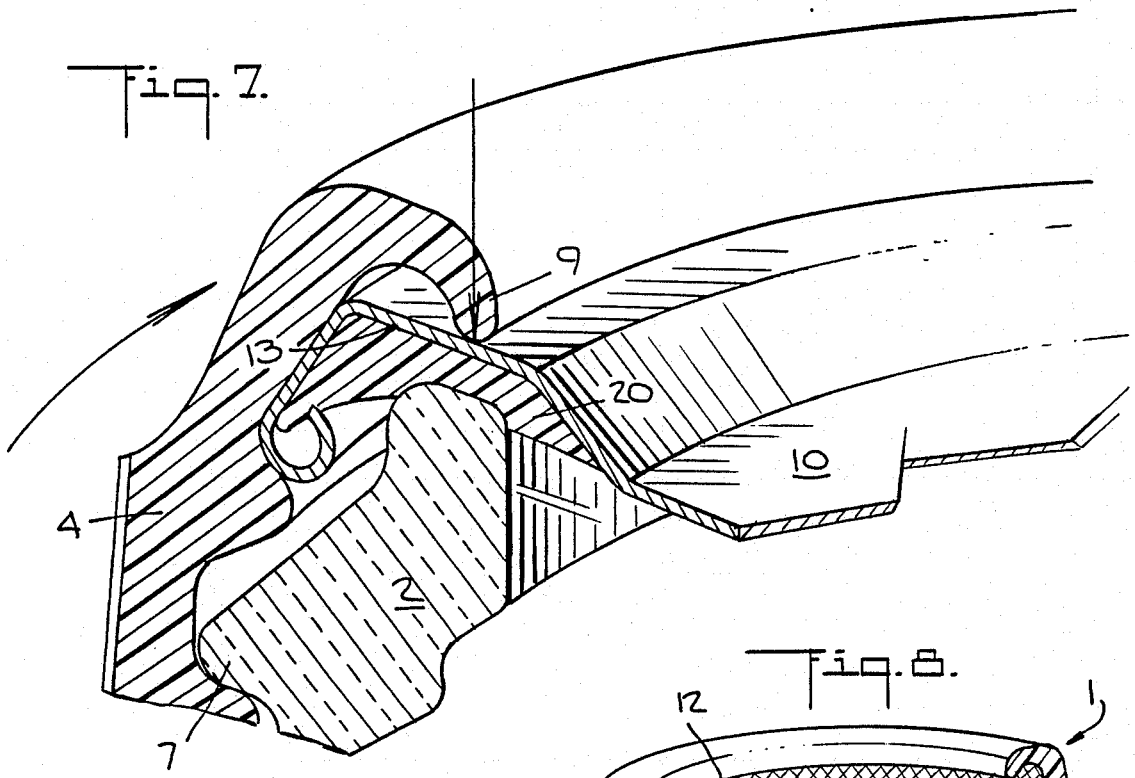
Fig. 8.
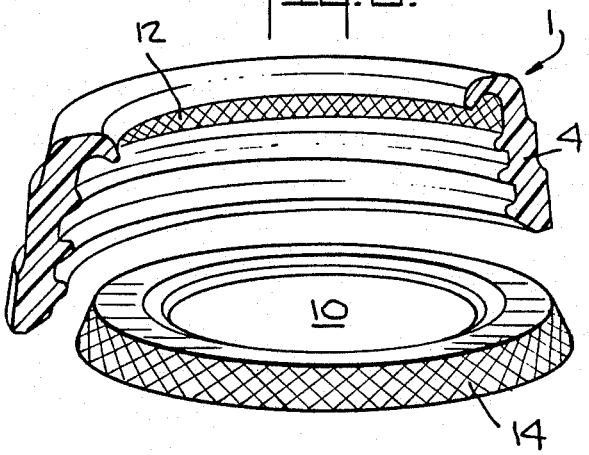
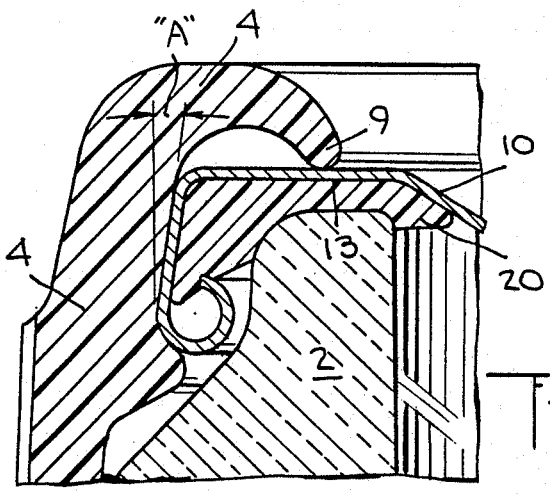
Fig. 10.
Fig. 9.
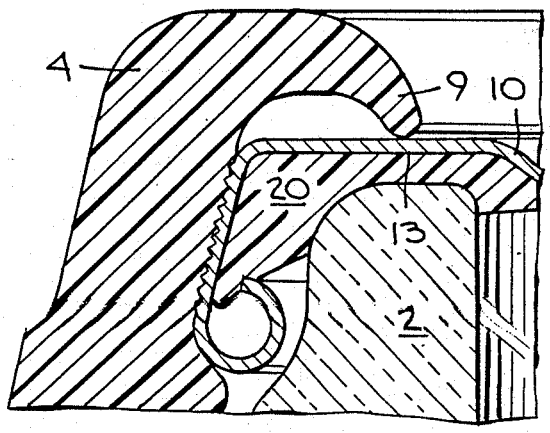
Fig. 11.
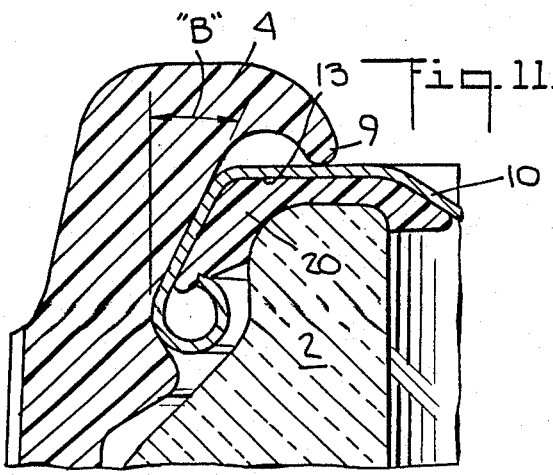

COMPOSITE CLOSURE CAP WITH REMOVAL TORQUE CONTROL

BACKGROUND OF THE INVENTION

The present invention relates to closure caps for sealing glass or plastic containers and more particularly to an improved composite closure cap having a metal cover and molded plastic container engaging ring. The metal cover and the plastic ring have tapered and engaging surfaces for a controlled closure cap removal torque.

Composite closure caps are well known and are widely used. They include a disc-like cover portion inserted into a circular molded plastic ring with the ring providing threaded or other means for attaching the composite cap to the container. A sealing gasket is provided on the metal cover and tamper indicating means are sometimes provided in the form of a vacuum indicator button on the cover with or without an additional tamper indicating band provided as a portion of the molded plastic ring.

While such composite closures have found acceptance in various packaging uses, including the vacuum packaging of food, prior composite closures have proven unsatisfactory for certain food packages where heat is applied during the sealing operations in retorting and otherwise. A serious drawback to certain of these prior closures has been a significant reduction in torque during the package handling and/or shelf life. The removal torque for the closure cap can become significantly reduced resulting in potential problems with consumer confidence and reduced resistance to abuse. Even where attempts have been made to increase this torque by the application of excess rotational force to the cap during application, the result has been creepage of portions of the plastic ring and container causing a loss of removal torque between the ring and threads and between the ring and the separate closure cover.

An object of this invention is to minimize this drop in removal torque by reducing the force in the plastic threads which cause it.

Other and further objects of the present invention will become apparent upon an understanding of the illustraive embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 7 is an enlarged perspective view illustrating the tapered portions of the cooperating plastic ring and cover.

FIG. 8 is a perspective view partially in section illustrating an embodiment of the closure including roughened and tapered torque control surfaces.

FIGS. 9 through 11 are fragmentary enlarged sectional views illustrating the sealing action at the top of the plastic ring and the outer edge of the cover.

Composite closures, as noted above, are in wide use particularly for sealing food packages. The following United States patents, for example, have been issued to the assignee of the present invention and these illustrate prior composite caps with a plastic sealing ring mounting a metal or plastic disc-like cover, i.e. U.S. Pat. No. 3,930,589 of Jan. 6, 1976; U.S. Pat. Nos. 3,913,772 and 3,913,771 both of Oct. 21, 1975.

DESCRIPTION OF THE PREFERRED EMBODIMENT

A preferred embodiment of the improved closure and package will now be described with particular references to the figures.

Figure 1:
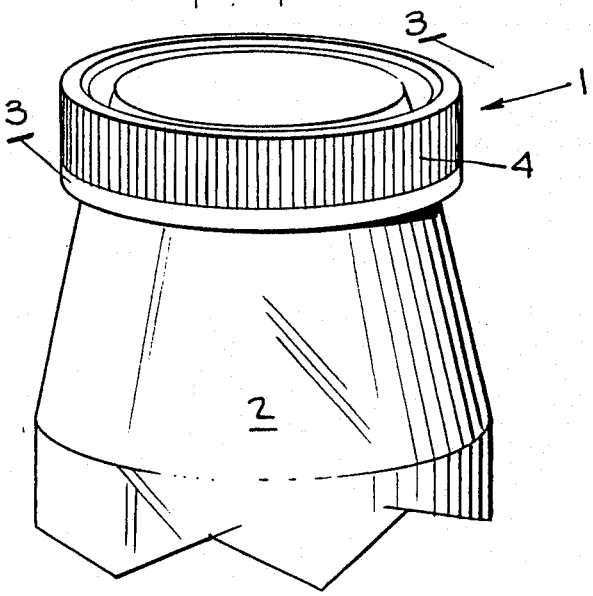
FIG. 1 is a perspective view of a sealed container in accordance with the invention.
Figure 2:
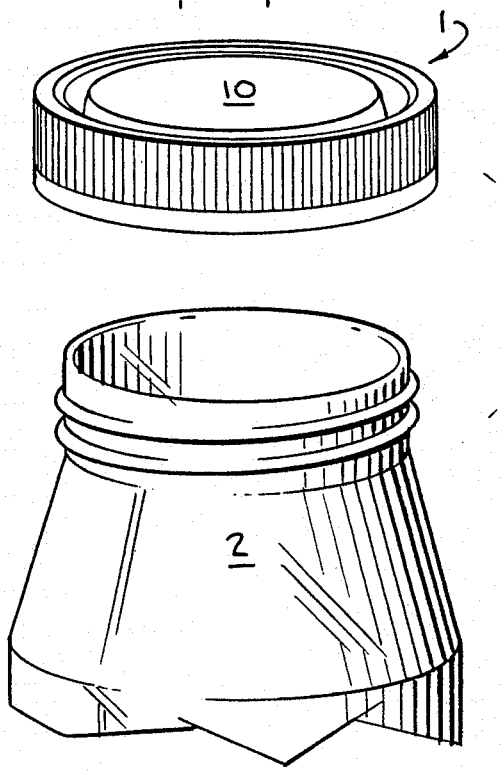
FIG. 2 is a perspective view illustrating an opened package.
Figure 3:
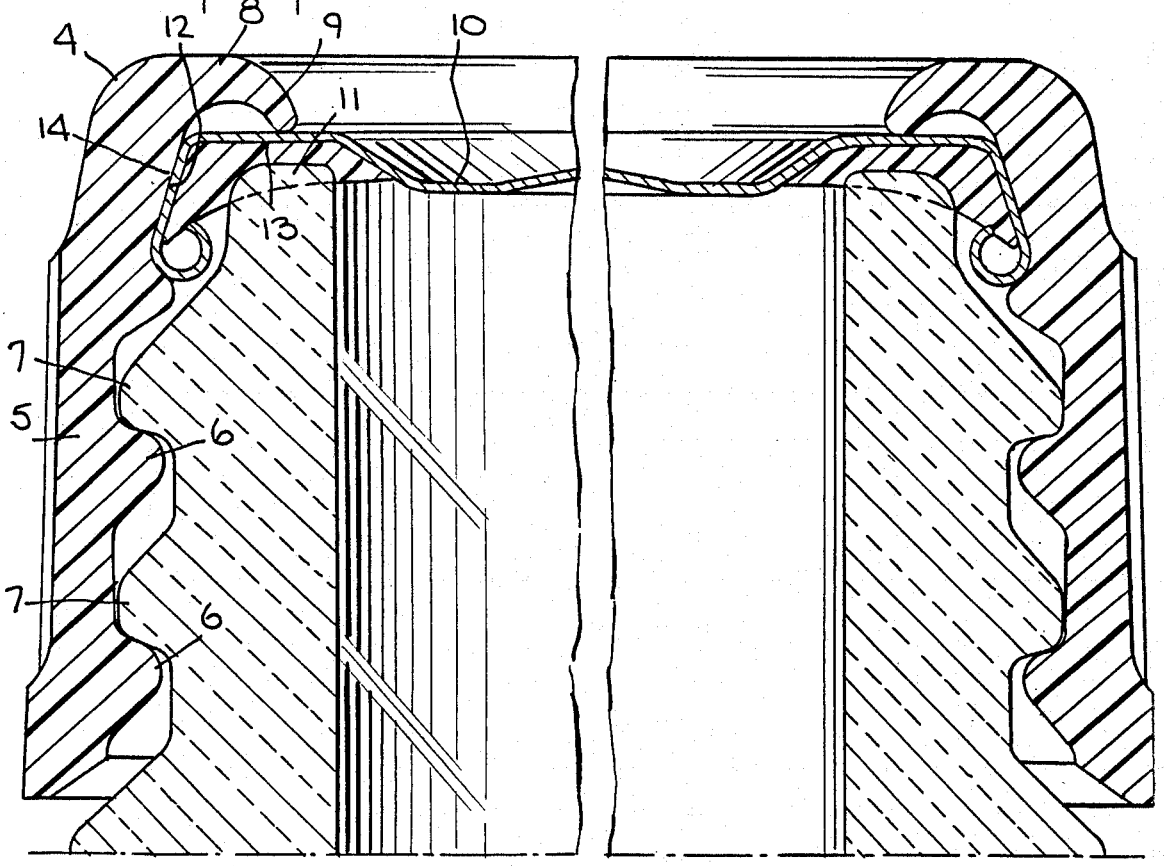
FIG. 3 is an enlarged vertical sectional view of the package of FIG. 1.
Figure 4:
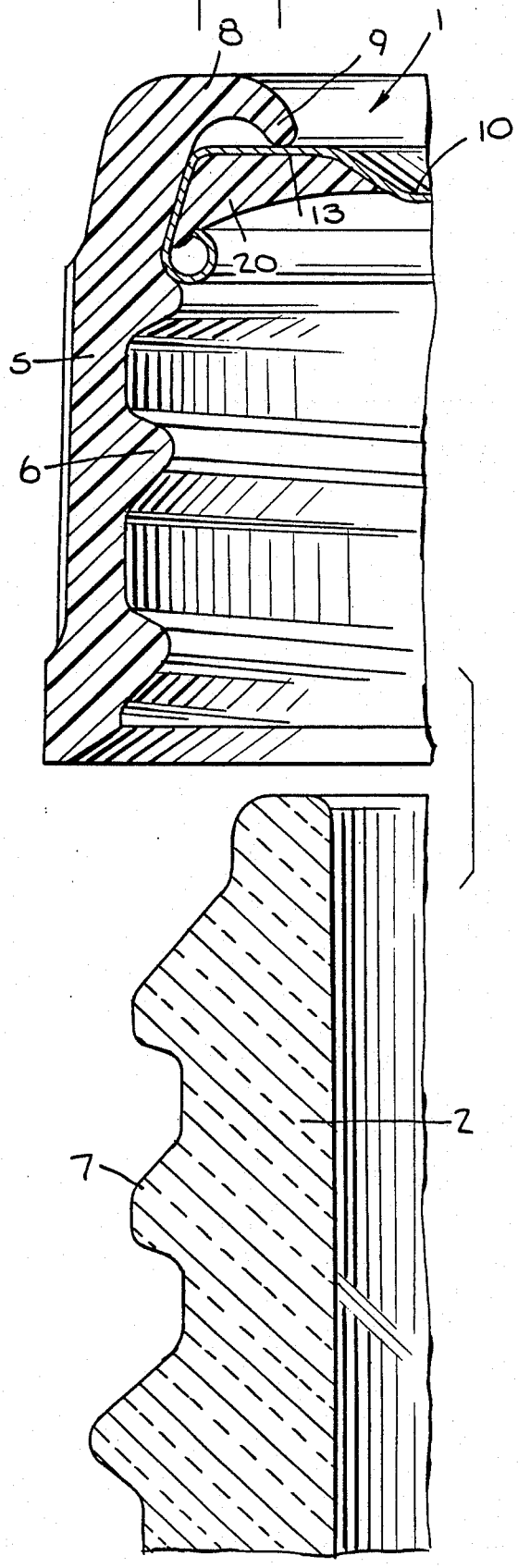
FIG. 4 is an enlarged vertical sectional view of the closure cap and container before sealing.

The closure 1 is applied to and seals a glass or plastic container 2. As illustrated in FIGS. 3 and 4, the molded plastic ring 4 is formed with a skirt portion 5 including inwardly directed threads 6 for engaging cooperating threads 7 at the container mouth. A radially inwardly directed flange 8 is formed at the top of the plastic ring 4. Together with the skirt portion 5 it forms a cover engaging corner with the inner edge 9 engaging and forcing the cover 10 into sealing engagement with the container rim 11. A tamper indicating band may form the lower portion of the plastic ring 4 and it is attached to the skirt portion 5 of the plastic ring 4 at a line of weakness as described in the above noted patents.

As illustrated at 12 in the figures, there is an inwardly and upwardly tapered surface near the top of the plastic band. Upon assembly of the closure 1, the cover 10 is inserted at the top of the ring 4 and the preferred embodiment of the cover 10 includes a downwardly facing gasket receiving channel 13 having a tapered radial outermost surface 14 shaped to conform to the ring taper for engagement therewith. The engaged surfaces 12 and 14 form a torque control means. The frictional engagement between these surfaces 12 and 14 upon closure cap application provides for a removal torque adjustment as will be described further below. Either the plastic surface 12 or the metal cover surface 14 or both may be roughened or scored as illustrated in FIG. 8 to increase the frictional engagement therebetween.

These engaged frictional surfaces 12 and 14 provide an adjustable amount of ring 4 retention torque which is set by controlling the sealing torque force during container sealing. The relative flared or "inclined plane" engagement between the cover and the plastic ring increases as the cap and the container threads draw the closure cap into sealing relation with the advantage resulting from the taper reducing the stress on the ring 4 threads 6. This is advantageous because the reduced thread and ring stresses permit them to remain in their original molded position without creepage during package storage and cause the removal torque as determined by the frictional engagement between the tapered surfaces to remain substantially constant and at the level obtained during the sealing.

Figure 5:
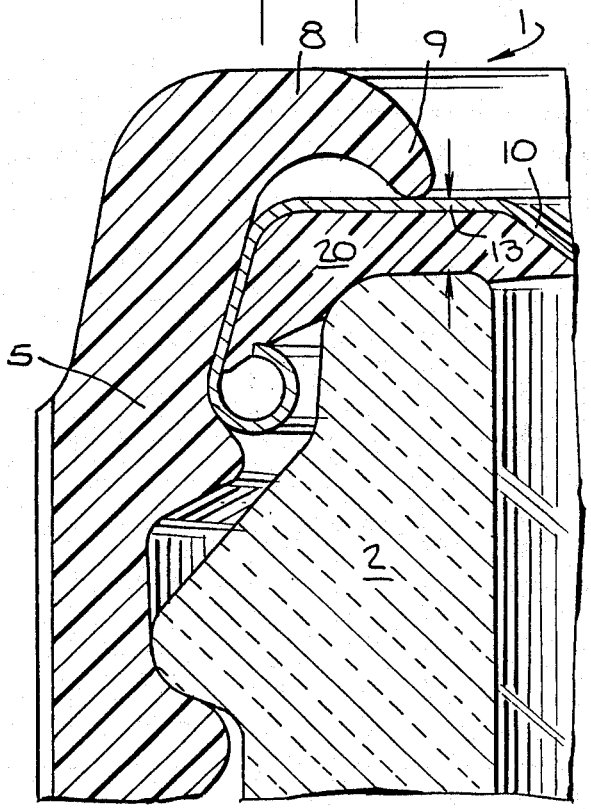
FIGS. 5 and 6 are enlarged sectional views of the package top illustrating the cover in two differing sealing positions.
Figure 6:
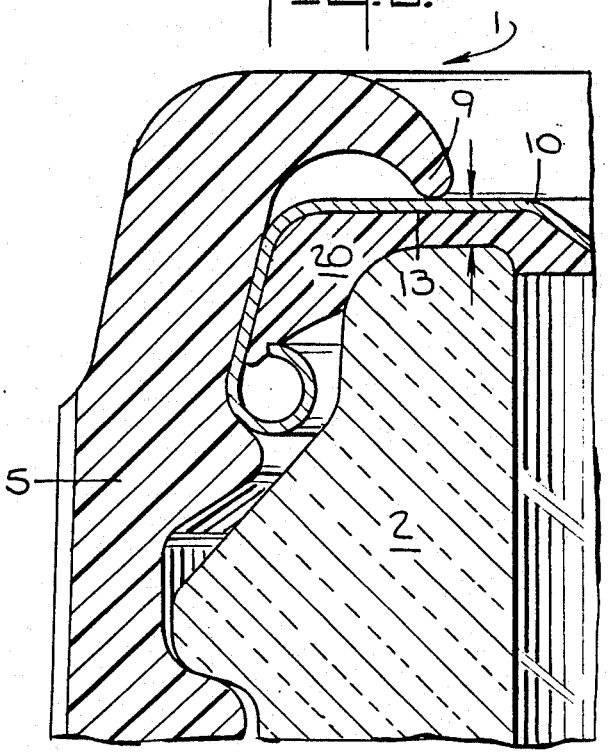

FIGS. 6 and 7 illustrate a closure cap 1 including the ring 4 and the cover 10 in sealing positions. FIG. 5 illustrates a seal made to provide a low degree of closure removal torque so that the cover and the ring are not screwed fully down on the container and are relatively higher on the sealed package. Nevertheless, the relatively thick channel 13 with the sealing gasket 20 are fully engaged with the rim 11 to form an effective top and side seal. The downward force generated at the ring threads 6 has been transferred to the upper portion of the ring 4 including the ring edge 9 and the flared ring and cover torque control surfaces 12 and 14.

FIG. 6 illustrates a seal where the ring 4 has been turned further down on the container rim resulting in an increase in the amount of removal torque created between the taper surfaces 12 and 14. In this case the ring inner edge 9 flexes upwardly to accommodate the change in ring position and an excellent top and side seal results between the gasket 20 and the container rim 11.

FIG. 7 is an enlarged perspective view showing the rotation of the ring 4 on the container threads 7 and showing the ring inner edge 9 forcing the cover 10 into sealing position as an additional sealing and torque controlling force is generated between the engaged tapered ring and cover torque control surfaces 12 and 14.

FIG. 9 is an enlarged sectional view showing the engaged and roughened tapered portions 12 and 14 in the embodiment of FIG. 8 and illustrating the generation of the significant and controllable torque removal force between the two engaged and roughened surfaces 12 and 14. One or the other of these surfaces may be left smooth where a satisfactory friction force is generated by a single roughened surface.

Enlarged sectional views 10 and 11 illustrate differing angular positions of the tapered surfaces with respect to the container axis. FIG. 10 illustrates a relatively small angle A in a situation where a relatively low degree of stress is placed on the ring threads 6 when drawing the cover 10 into its sealed position as illustrated. This sharper angular relationship maximizes the more radially directed component of force between the plastic ring 4 and the cover 10 to provide a relatively high closure retention and removal torque while the low stress on the plastic threads minimizes plastic creep and unintentional closure loosening.

FIG. 11 illustrates a wider angle B providing for a minimized radially directed component of the force between the ring and the cover providing a still effective removal torque control without a significantly increased stress on the ring threads.

It will be seen that an improved composite closure is provided which provides a package with minimized creep in the plastic ring of the closure and with a predetermined torque control.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. A composite closure cap for sealing a container comprising the combination of a molded plastic ring and a separate closure cover contained in said plastic ring, said container having a top sealing surface at its rim, and said cover having a sealing means adapted to form a seal with said top sealing surface and a flat flared torque control surface for engaging a complementary flared torque control surface on said plastic ring, said control surfaces forming an acute angle with the vertical.

2. A composite closure cap for sealing a container comprising the combination of a molded plastic ring and a separate closure cover contained in said plastic ring, said container having a top sealing surface at its rim, and said cover having a sealing means adapted to form a seal with said top sealing surface and a flared torque control surface for engaging a complementary flared torque control surface on said plastic ring, and at least one of said flared torque control surfaces being roughened.

3. The closure cap as claimed in claim 2 which further comprises lift means for engaging said cover flange positioned on said plastic ring and spaced downwardly from the lower edge of said flange.

4. The closure cap as claimed in claim 3 in which said lift means comprises a radially inwardly directed circular bead on said plastic ring.

5. A composite closure cap for sealing a container comprising the combination of a molded plastic ring and a separate closure cover contained in said plastic ring, said container having a top sealing surface at its rim, and said cover having a sealing means adapted to form a seal with said top sealing surface and a flared torque control surface for engaging a complementary flared torque control surface on said plastic ring, and said flared torque control surfaces have roughened surfaces.

* * * * *